US007516737B2

(12) United States Patent
Cerabone et al.

(10) Patent No.: US 7,516,737 B2
(45) Date of Patent: Apr. 14, 2009

(54) INTERNAL COMBUSTION ENGINE WITH COOLING SYSTEM AND EXHAUST GAS RECIRCULATION SYSTEM

(75) Inventors: Victor Cerabone, Waterford, MI (US); Harald Gieb, Weinstedt (DE); Michael Hoffmann, Weinstadt (DE); Walter Kerschbaum, Schorndorf (DE); Eberhard Schneider, Rudersberg (DE); Gotz von Esebeck, Mahlow (DE)

(73) Assignee: Daimler AG, Stuttgart (DE)

( * ) Notice: Subject to any disclaimer, the term of this patent is extended or adjusted under 35 U.S.C. 154(b) by 0 days.

(21) Appl. No.: 12/006,712

(22) Filed: Jan. 5, 2008

(65) Prior Publication Data

US 2008/0257317 A1 Oct. 23, 2008

Related U.S. Application Data

(63) Continuation-in-part of application No. PCT/EP2006/006176, filed on Jun. 27, 2007.

(30) Foreign Application Priority Data

Jul. 5, 2005 (DE) ..... 10 2005 031 300

(51) Int. Cl.
*F02B 47/08* (2006.01)
*F02M 25/07* (2006.01)

(52) U.S. Cl. ..... 123/568.12; 123/41.29

(58) Field of Classification Search ..... 29/888.01, 29/890.032; 123/41.28, 41.29, 41.31, 41.72, 123/41.79, 321, 568.11, 568.12, 568.13; 701/108

See application file for complete search history.

(56) References Cited

U.S. PATENT DOCUMENTS

| | | | | |
|---|---|---|---|---|
| 4,258,687 | A | 3/1981 | Mauch et al. | |
| 5,490,488 | A * | 2/1996 | Aversa et al. | 123/568.12 |
| 6,186,127 | B1 * | 2/2001 | Everingham | 123/568.12 |
| 6,360,702 | B1 * | 3/2002 | Osada | 123/41.31 |
| 6,478,009 | B1 * | 11/2002 | Seitz et al. | 123/321 |
| 6,478,017 | B2 | 11/2002 | Bianchi | |
| 7,073,491 | B2 * | 7/2006 | Yi | 123/568.12 |
| 7,089,890 | B2 * | 8/2006 | Obidi | 123/41.31 |
| 7,314,037 | B2 * | 1/2008 | Roithinger | 123/316 |

FOREIGN PATENT DOCUMENTS

| | | | |
|---|---|---|---|
| DE | 101 19 484 | | 10/2002 |
| EP | 1 099 847 | | 11/2000 |
| EP | 1 233 170 | | 8/2002 |
| JP | 10 002256 | | 1/1998 |
| JP | 2000 248936 | | 9/2000 |
| JP | 2001 030995 | | 2/2001 |
| JP | 2001 227414 | | 8/2001 |
| JP | A-2002030995 | * | 1/2002 |

* cited by examiner

*Primary Examiner*—Stephen K Cronin
*Assistant Examiner*—David Hamaoui
(74) *Attorney, Agent, or Firm*—Klaus J. Bach

(57) ABSTRACT

In an internal combustion engine with a cooling system and an exhaust gas recirculation (EGR) system including an EGR heat exchanger with a coolant inlet opening connected to a coolant outlet opening of the engine for receiving coolant therefrom and the engine including a coolant collecting rail mounted directly to the engine and having a coolant inlet opening connected to the EGR heat exchanger and at least one other coolant inlet opening in communication directly with at least one other coolant outlet opening of the engine.

11 Claims, 3 Drawing Sheets

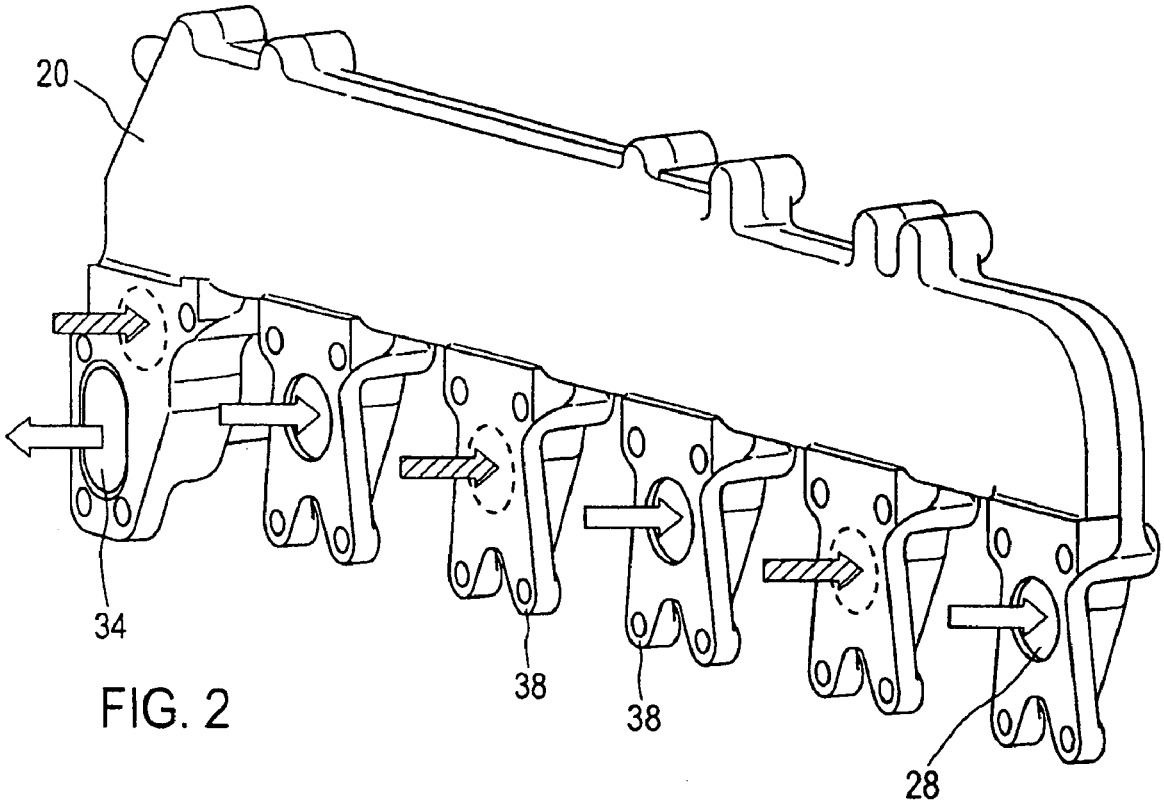
FIG. 2
FIG. 3
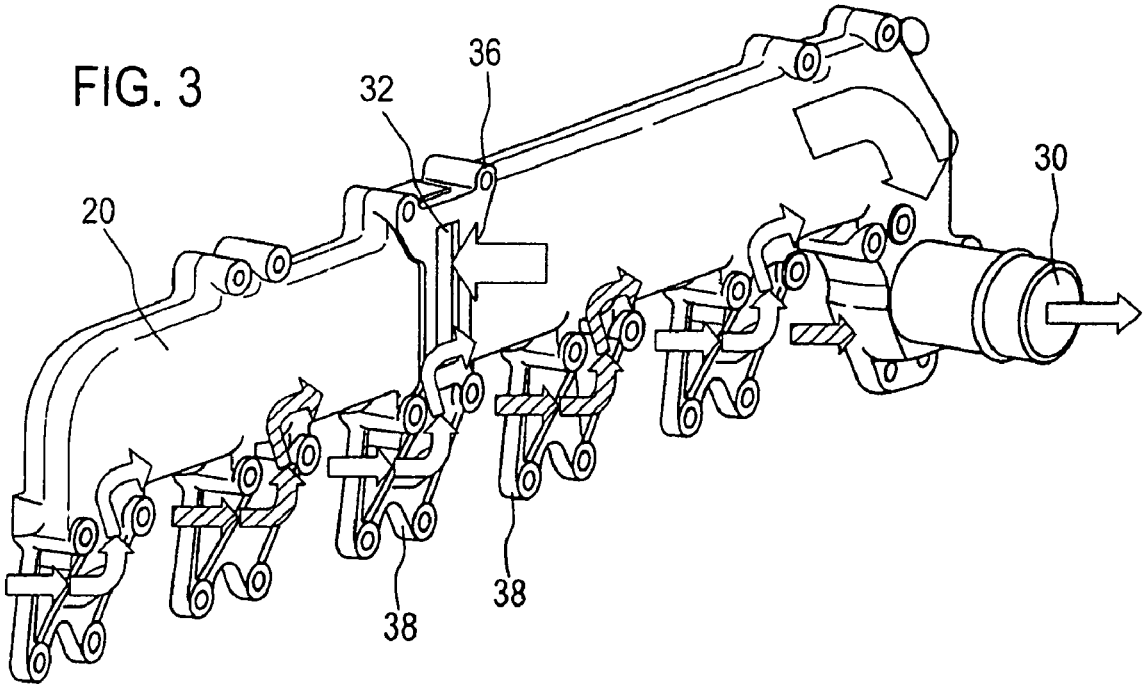

INTERNAL COMBUSTION ENGINE WITH COOLING SYSTEM AND EXHAUST GAS RECIRCULATION SYSTEM

This is a Continuation-In-Part Application of pending international application PCT/EP2006/006176 filed Jun. 27, 2007 and claiming the priority of German Application 10 2005 031 300.0 filed Jul. 5, 2005.

BACKGROUND OF THE INVENTION

The invention relates to an internal combustion engine with a cooling system and exhaust gas recirculation system and with a coolant collecting rail extending alongside the engine for collecting the coolant from the areas around the various cylinders.

An internal combustion engine for a motor vehicle conventionally comprises an engine housing with a cylinder head, a plurality of cylinders and a plurality of coolant lines. The coolant lines are connected by means of at least one coolant inflow opening to a coolant pump for feeding a cooled coolant to the engine, and by way of at least one coolant outflow opening to a coolant collecting rail. The coolant collecting rail correspondingly has at least one first coolant inflow opening and a coolant outflow opening which is connected by means of a coolant line to a cooler for cooling the coolant. The coolant which is cooled in the cooler in this way is then returned to the coolant pump.

In an internal combustion engine with an exhaust gas recirculation (EGR) system, a part of the exhaust gases of the internal combustion engine can be supplied via an EGR line back to the intake duct of the internal combustion engine. An EGR heat exchanger for cooling the recirculated exhaust gas is arranged in the EGR line, and the EGR flow is controlled by means of an EGR valve which may likewise be cooled. The EGR heat exchanger and the EGR valve are therefore likewise constituents of the cooling system, and the EGR heat exchanger has a coolant inflow opening, which is connected to the coolant pump, and a coolant outflow opening. The coolant outflow opening of the EGR heat exchanger is connected to a second coolant inflow opening of the coolant collecting rail, so that all of the coolant of the cooling system is collected in the coolant collecting rail.

The cooling system of the internal combustion engine generally has further components, such as for example oil coolers, compensating tanks, thermostat valves, various pressure sensors and temperature sensors and the like, which are however not of significance for the present invention.

On account of the ever more restricted available installation space, there is demand for compact constructions for internal combustion engines of said type.

It is thus for example known from the documents DE 101 19 484 A1, JP-A-2000-248936 and JP-A-2002-030995 to mount the EGR heat exchanger directly on the cylinder head of the engine housing. In JP-A-2001-227414, the EGR valve is fastened directly to the cylinder head.

U.S. Pat. No. 6,478,017 discloses an internal combustion engine in which the complete EGR line including the EGR heat exchanger is integrated in the engine housing.

It is the object of the present invention to provide a compact and at the same time cost-effective arrangement of a cooling system and exhaust gas recirculation system of an internal combustion engine.

SUMMARY OF THE INVENTION

In an internal combustion engine with a cooling system and an exhaust gas recirculation (EGR) system including an EGR heat exchanger with a coolant inlet opening connected to a coolant outlet opening of the engine for receiving coolant therefrom and the engine including a coolant collecting rail mounted directly to the engine and having a coolant inlet opening connected to the EGR heat exchanger and at least one other coolant inlet opening in communication directly with at least one other coolant outlet opening of the engine.

The internal combustion engine with a cooling system and exhaust gas recirculation system comprises an engine housing with a cylinder head, a plurality of cylinders and a plurality of coolant lines, with the engine housing being provided with at least one coolant inflow opening and at least one coolant outflow opening; a coolant collecting rail with at least one first coolant inflow opening which is connected to a coolant outflow opening of the engine housing, and with a coolant outflow opening which is connected by means of a coolant line to a cooler; and an EGR heat exchanger with exhaust gas flow passages and coolant passages which are in heat-exchanging relationship with one another, and with a coolant inflow opening and a coolant outflow opening. In accordance with the invention the EGR heat exchanger is fastened directly to the coolant collecting rail, and the coolant outflow opening of the EGR heat exchanger is connected directly to a second coolant inflow opening of the coolant collecting rail.

According to a particular aspect of the invention, the coolant collecting rail is mounted directly to the engine and is also directly connected at least to the first coolant inlet opening of the coolant collecting rail.

The internal combustion engine with a cooling system and exhaust gas recirculation system comprises an engine housing with a cylinder head, a plurality of cylinders and a plurality of coolant lines, with the engine housing being provided with at least one coolant inflow opening and at least one coolant outflow opening; a coolant collecting rail with at least one first coolant inflow opening which is connected to a coolant outflow opening of the machine housing, and with a coolant outflow opening which is connected by means of a coolant line to a cooler; and an EGR heat exchanger with an exhaust gas duct and a coolant duct which are in heat-exchanging contact with one another, and with a coolant inflow opening and a coolant outflow opening. It is provided according to the invention that the coolant collecting rail is fastened directly to the engine housing and that the at least one coolant outflow opening of the engine housing is connected directly to at least one coolant inflow opening of the coolant collecting rail.

In a combination of the first and second embodiment, it is also possible on the one hand for the EGR heat exchanger to be fastened directly to the coolant collecting rail, with the coolant outflow opening of the EGR heat exchanger being connected directly to the second coolant inflow opening of the coolant collecting rail, and, on the other hand, for the coolant collecting rail to be fastened directly to the engine housing, in particular to its cylinder head, with the at least one coolant outflow opening of the engine housing being connected directly to the at least one first coolant inflow opening of the coolant collecting rail.

In the internal combustion engine of the present invention preferably the components of engine housing, that is, the coolant collecting rail and EGR heat exchanger, which can be produced separately and therefore cost-effectively, are connected to one another in a very compact fashion in a twin or triple configuration, so that on the one hand the required installation space is minimized, and on the other hand it is possible to dispense with additional coolant lines between the individual components.

In a particular embodiment of the invention, the coolant collecting rail may have a short circuit duct opening which can be connected by means of a short circuit duct directly to the coolant pump.

Preferably, the coolant collecting rail has a first fastening flange to which the EGR heat exchanger is directly fastened, and the second coolant inflow opening of the coolant collecting rail is integrated in a compact fashion into the first fastening flange. In addition, the coolant collecting rail has at least one second fastening flange, by means of which the coolant collecting rail is fastened directly to the engine housing, and the coolant inflow passages of the coolant collecting rail are integrated in a compact fashion in the second fastening flanges.

The coolant outflow opening of the coolant collecting rail can if required also be connected to a vehicle brake device (retarder).

In a yet further embodiment of the invention, the internal combustion engine is also provided with an EGR valve which can be fastened either directly to the coolant collecting rail or directly to the EGR heat exchanger.

It is also possible for the coolant collecting rail to have a ventilation device for ventilating the cooling system of the internal combustion engine.

The invention will become more readily apparent from the following description of a preferred exemplary embodiment of the invention with reference to the accompanying drawings:

BRIEF DESCRIPTION OF THE DRAWINGS

FIG. 2 shows in a schematic perspective view the coolant collecting rail of the internal combustion engine of FIG. 1 from the aspect of the machine housing;

FIG. 3 shows a schematic perspective view of the coolant collecting rail of the internal combustion engine of FIG. 1 from the outside.

DESCRIPTION OF A PARTICULAR EMBODIMENT

A preferred exemplary embodiment of a compact internal combustion engine according to the present invention will be explained with reference to FIGS. 1 to 3. Herein, the same reference symbols are used throughout the description for identical components.

Figure 1:
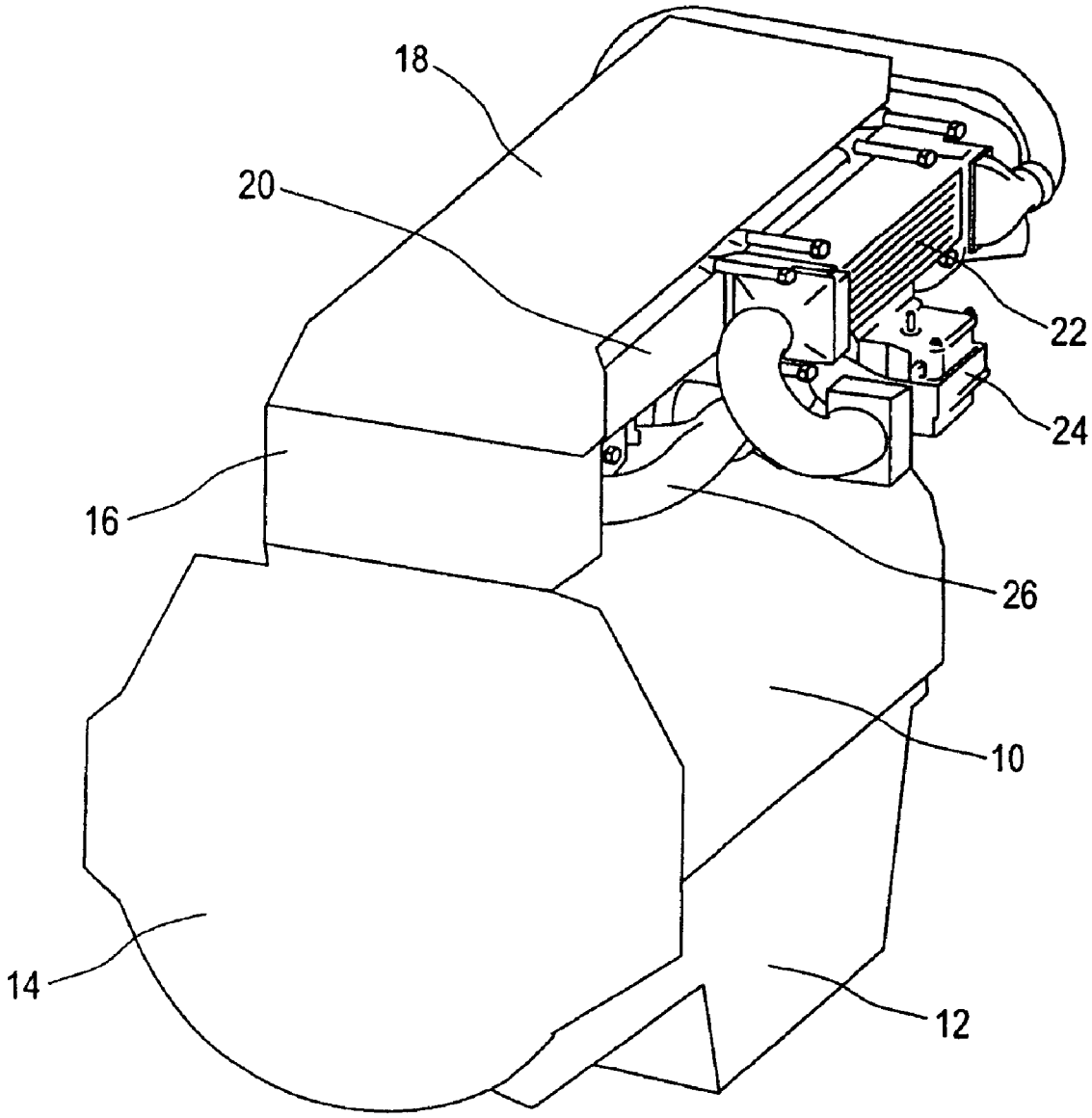
FIG. 1 shows schematically a perspective view of an internal combustion engine including a coolant collecting rail and an EGR heat exchanger with an EGR valve.

The internal combustion engine which is illustrated in simplified form in FIG. 1 has, in a known way, a engine housing with an engine block 10, an oil sump 12, a timing case 14, a cylinder head 16 with a plurality of cylinders and a cylinder head cover 18. The invention however is not restricted to the arrangement of said components as shown in FIG. 1.

The internal combustion engine also has, in a known way, an exhaust manifold 26 and an exhaust gas recirculation (EGR) system. The EGR system comprises in particular an exhaust gas recirculation line, an EGR heat exchanger 22 and an EGR valve 24.

As part of a cooling system which is already fundamentally known, the internal combustion engine has a coolant pump (not illustrated) for feeding a coolant (generally cooling water) at low temperature to coolant passages in the engine housing for cooling the components of the engine housing and also to coolant lines of the EGR system for cooling the components of the EGR system. The cooling system further includes a coolant collecting rail 20 for collecting the heated coolant from the coolant passages of the engine housing and of the EGR system and a cooler (not illustrated) for cooling the coolant supplied from the coolant collecting rail 20, which coolant is then supplied to the coolant pump. There are further components of a cooling system which are however not relevant to the pre-sent invention including for example oil coolers, fuel coolers, compensating tanks, thermostatic valves, various pressure sensors and temperature sensors and the like.

In order to obtain a compact and at the same time cost-effective design of said internal combustion engine with a cooling system and EGR system, the coolant collecting rail 20 is mounted directly to the engine housing (preferably to the cylinder head), and the EGR heat exchanger 22 is mounted directly to the coolant collecting rail 20. It is alternatively also possible for only the coolant collecting rail 20 to be mounted directly to the engine housing or for only the EGR heat exchanger 22 to be mounted directly to the coolant collecting rail 20.

The coolant collecting rail 20 is preferably in the form as shown in FIGS. 2 and 3.

On its side facing toward the engine housing (see FIG. 2), the coolant collecting rail 20 is provided with a plurality of first coolant inflow openings 28 which are connected directly, that is to say without the interposition of coolant lines, to corresponding coolant outflow openings of the engine housing (preferably of the cylinder head). The solid arrows represent the coolant connections which exist in the exemplary embodiment of FIGS. 2 and 3, while the hatched arrows indicate further optional coolant connections. On its side facing away from the engine housing (see FIG. 3), the coolant collecting rail 20 has a coolant outflow opening 30 which is connected by a coolant line to the cooler.

The coolant collecting rail 20 also has a short circuit duct opening 34 for connection directly by means of a short circuit duct (not illustrated) to the coolant pump, which can for example be provided on the side which faces toward the engine housing.

Finally, the coolant collecting rail 20 also has a second coolant inflow opening 32 which is connected directly, that is to say without the interposition of further coolant lines, to the coolant outflow opening of the EGR heat exchanger 22.

The coolant collecting rail 20 therefore collects all of the coolant in the cooling system of the internal combustion engine and conducts said coolant via the coolant outflow opening 30 back to the cooler.

For better understanding, arrows are shown in FIGS. 2 and 3, which arrows are intended to indicate the coolant flow from the engine housing and the EGR system through the coolant collecting rail 20.

Figure 4:
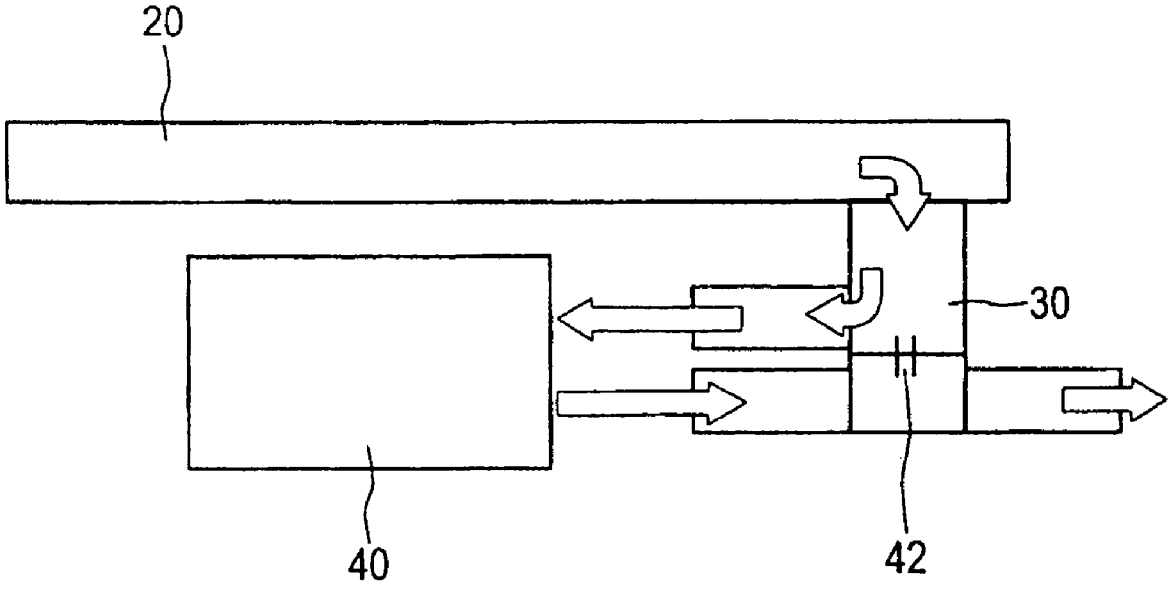
FIG. 4 is a schematic illustration of the coolant collecting rail with a retarder circuit.

While, in the above-described exemplary embodiment, the coolant outflow piece 30 of the coolant collecting rail 20 is connected directly to the cooler, the coolant outflow piece 30 can alternatively also be connected firstly to a vehicle brake device (retarder) 40, as shown schematically in FIG. 4.

After flowing through said retarder 40, the coolant is recirculated back to the connecting piece 30 and is then finally supplied via a further connection to the cooler. In this case, 100% of the coolant is conducted from the coolant collecting rail 20 through the vehicle brake device 40.

If a bypass duct 42 (if appropriate with a bypass valve (not illustrated)) is inserted at the connection piece 30 between the outlet to the vehicle brake device 40 and the outlet to the cooler, then the coolant quantity conducted to the vehicle brake device 40 can also be set to values below 100%.

Alternatively to the embodiment illustrated in FIG. 4, the connection piece 30 can of course also be attached at the other end of the coolant collecting rail 20.

For direct attachment of the EGR heat exchanger 22 to the coolant collecting rail 20, the coolant collecting rail 20 is provided with a first fastening flange 36. In a compact design, the second coolant inflow opening 32 of the coolant collecting rail 20 for receiving the coolant from the EGR heat exchanger 22 is also integrated in said first fastening flange 36.

In a similar way, the coolant collecting rail 20 has, for direct assembly on the machine housing of the internal combustion engine, a plurality of second fastening flanges 38. Likewise in a compact arrangement, the first coolant inflow opening 28 of the coolant collecting rail 20 for receiving the coolant from the machine housing may be integrated in the second fastening flanges 38.

The coolant collecting rail 20 as shown permits a compact construction of the internal combustion engine with the components of engine housing, coolant collecting rail and EGR heat exchanger which are produced individually and integrated in a triple configuration.

The EGR valve 24 of the EGR system is, in a compact arrangement, fastened either directly to the coolant collecting rail 20 or directly to the EGR heat exchanger 22. It is also possible for the coolant collecting rail 20 to have a ventilation device for ventilating the cooling system of the internal combustion engine.

What is claimed is:

1. An internal combustion engine with a cooling system and an exhaust gas recirculation system, comprising:

an engine housing with a cylinder head, a plurality of cylinders and a plurality of coolant passages, with the engine housing having at least one coolant inflow opening and at least one coolant outflow opening;

a coolant collecting rail (20) with at least one first coolant inflow opening (28) which is connected to a coolant outflow opening of the engine housing, and with a coolant outflow opening (30) which is connected by means of a coolant line to a cooler; and an EGR heat exchanger (22) in connection with an exhaust gas duct and a coolant duct which are in heat-exchanging relationship with one another, and with a coolant inflow opening and a coolant outflow opening, the EGR heat exchanger (22) being fastened directly to the coolant collecting rail (20); and the coolant outflow opening of the EGR heat exchanger (22) being connected directly to a second coolant inflow opening (32) of the coolant collecting rail (20).

2. The internal combustion engine as claimed in claim 1, wherein the coolant collecting rail (20) is fastened directly to the engine housing; and the at least one coolant outflow opening of the engine housing is connected directly to the at least one first coolant inflow opening (28) of the coolant collecting rail (20).

3. An internal combustion engine with a cooling system and exhaust gas recirculation system, including:

a machine housing with a cylinder head, a plurality of cylinders and a plurality of coolant passages, with the engines housing being provided with at least one coolant inflow opening and at least one coolant outflow opening;

a coolant collecting rail (20) with at least one first coolant inflow opening (28) which is connected to a coolant outflow opening of the engine housing, and with a coolant outflow opening (30) which is connected by means of a coolant line to a coolant cooler; and an EGR heat exchanger (22) with exhaust gas passages and coolant passages which are in heat-exchanging relationship with one another, and including a coolant inflow opening and a coolant outflow opening, the coolant collecting rail (20) being fastened directly to the machine housing; and the at least one coolant outflow opening of the engine housing being connected directly to the at least one first coolant inflow opening (28) of the coolant collecting rail (20).

4. The internal combustion engine as claimed in claim 3, wherein the EGR heat exchanger (22) is fastened directly to the coolant collecting rail (20); and the coolant outflow opening of the EGR heat exchanger (22) is connected directly to a second coolant inflow opening (32) of the coolant collecting rail (20).

5. The internal combustion engine as claimed in claim 1, wherein a coolant collecting rail (20) has a short circuit duct opening (34) which can be connected directly to the coolant pump.

6. The internal combustion engine as claimed in claim 1, wherein the coolant collecting rail (20) has a first fastening flange (36) to which the EGR heat exchanger (22) is directly fastened; and the second coolant inflow opening (32) of the coolant collecting rail (20) is integrated in the first fastening flange (36).

7. The internal combustion engine as claimed in claim 3, wherein the coolant collecting rail (20) has at least one second fastening flange (38), by means of which said coolant collecting rail (20) is fastened directly to the engine housing; and the at least one first coolant inflow opening (28) of the coolant collecting rail (20) is integrated in the at least one second fastening flange (38).

8. The internal combustion engine as claimed in claim 5, wherein the engine includes a vehicle brake device (40) and the coolant outflow opening (34) of the coolant collecting rail (20) can be connected to the vehicle brake device (40).

9. The internal combustion engine as claimed in claim 1, wherein the internal combustion engine is also provided with an EGR valve (24) which is fastened directly to the coolant collecting rail (20).

10. The internal combustion engine as claimed in claim 1, wherein the internal combustion engine is also provided with an EGR valve (24) which is fastened directly to the EGR heat exchanger (22).

11. The internal combustion engine as claimed in claim 1, wherein the coolant collecting rail (20) also has a venting device for venting the cooling system of the internal combustion engine.

* * * * *